US008430470B2

(12) United States Patent
Murase et al.

(10) Patent No.: US 8,430,470 B2
(45) Date of Patent: Apr. 30, 2013

(54) PRINTING APPARATUS TO PREVENT COLOR MIXTURE OF INKS IN MOUNTED PRINT HEADS

(75) Inventors: Takeshi Murase, Yokohama (JP); Minoru Teshigawara, Saitama (JP); Atsushi Sakamoto, Kawasaki (JP); Yoshiyuki Honda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 184 days.

(21) Appl. No.: 12/964,287

(22) Filed: Dec. 9, 2010

(65) Prior Publication Data

US 2012/0075379 A1 Mar. 29, 2012

(30) Foreign Application Priority Data

Sep. 28, 2010 (JP) ..... 2010-217189

(51) Int. Cl.
*B41J 29/38* (2006.01)

(52) U.S. Cl.
USPC ..... 347/14; 347/20; 347/85

(58) Field of Classification Search ..... 347/14, 347/19, 20, 44, 47, 56, 61–65, 67, 84–87, 347/49
See application file for complete search history.

(56) References Cited

U.S. PATENT DOCUMENTS 6,502,916 B1 1/2003 Naka
6,550,882 B2 4/2003 Koitabashi

*Primary Examiner* — Juanita D Jackson
(74) *Attorney, Agent, or Firm* — Canon USA, Inc., IP Division

(57) ABSTRACT

There is provided a printing apparatus capable of mounting common print heads, and capable of preventing color mixture of inks in a configuration in which a plurality of ink supply mechanisms is provided. The same print heads can be mounted on the first head mounting unit and the second head mounting unit, and the print head has a storage region, in which color information of the head mounting unit is stored, when the print head is mounted on the first head mounting unit or the second head mounting unit.

8 Claims, 9 Drawing Sheets

PRINTING APPARATUS TO PREVENT COLOR MIXTURE OF INKS IN MOUNTED PRINT HEADS

BACKGROUND OF THE INVENTION

1. Field of the Invention

The present invention relates to a printing apparatus that ejects an ink from a print head.

2. Description of the Related Art

In U.S. Pat. No. 6,550,882, an inkjet printer using a full-line type print head is discussed. The printer is configured to eject inks or processing liquids from a plurality of print heads arranged at a predetermined interval along a conveying direction of a sheet to carry out printing thereon.

In U.S. Pat. No. 6,502,916, an inkjet recording apparatus that ejects inks from a plurality of recording heads to carry out recording thereon is discussed. Then, it is discussed that a storage unit of an ink cartridge stores a type of an ink contained in the ink cartridge, and a storage unit of the recording head stores a type of the recording head. Furthermore, data is read out from respective storage units, when the ink cartridges are mounted on the recording heads, and matching between the ink cartridges and the recording heads is determined However, in the invention discussed in the U.S. Pat. No. No. 6,550,882, if a configuration in which the print heads can be attached to and detached from an apparatus main body is employed, a separate print head must be prepared for each ink color. By combining the invention discussed in the U.S. Pat. No. 6,550,882 with the invention discussed in the U.S. Pat. No. 6,502,916, and by causing the storage units of the print head to store a type of the contained ink in advance, erroneous mounting of the print head can be prevented. However, even if the U.S. Pat. No. 6,550,882 and the U.S. Pat. No. 6,502,916 are combined, a separate print head must be prepared for each ink color, and thus a technical problem that manufacturing cost and management cost of the print heads will become high cannot be solved

SUMMARY OF THE INVENTION

The present invention is directed to providing a printing apparatus capable of mounting common print heads and preventing color mixture of inks, by providing a plurality of ink supply mechanisms.

According to an aspect of the present invention, there is provided a printing apparatus including a first ink tank configured to contain an ink of a first color, a second ink tank configured to contain an ink of a second color, a first head mounting unit configured to mount thereon a print head, which is supplied with an ink contained in the first ink tank and ejects the ink, and a second head mounting unit configured to mount thereon a print head, which is supplied with an ink contained in the second ink tank and ejects the ink, wherein the same print heads can be mounted on the first head mounting unit and the second head mounting unit print head, and the print head has a storage region in which color information of the head mounting units is stored when mounted on the first head mounting unit or the second head mounting unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Hereinbelow, an exemplary embodiment of a printing apparatus using an inkjet scheme will be described. The printing apparatus according to the present exemplary embodiment is a high-speed line printer using continuous sheet of long length (sheet longer than a length of unit image and continuous in a conveying direction) wound up in a roll shape and adapted to both of single-sided print and two-sided print. For example, it is suitable for a field of mass printing in a print laboratory. The present invention is applicable to printing apparatuses such as a printer, a printer multifunctional peripheral, a copying machine, and a facsimile apparatus.

Figure 1:
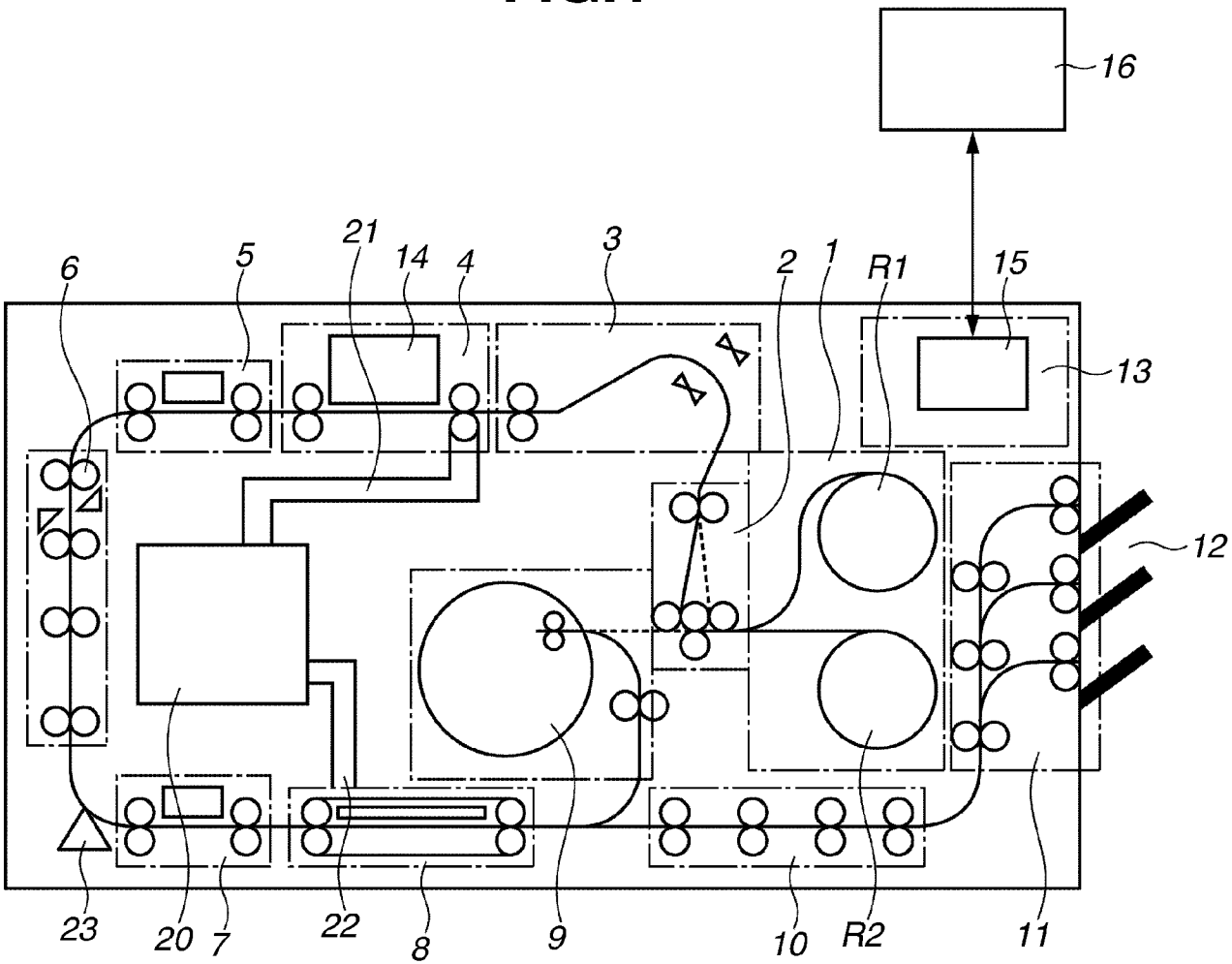
FIG. 1 is a schematic view illustrating an internal configuration of a printing apparatus.

FIG. 1 is a schematic view of a cross-section illustrating an internal configuration of the printing apparatus. The printing apparatus according to the present exemplary embodiment is capable of printing on two-sides of a first surface of a sheet and a second surface as a back surface side of the first surface, using the sheet wound up in a roll shape. Inside the printing apparatus, there are mainly such units as a sheet supply unit 1, a decurling unit 2, a skew correction unit 3, a printing unit 4, an inspection unit 5, a cutter unit 6, an information recording unit 7, a drying unit 8, a reversing unit 9, a discharge and conveyance unit 10, a sorter unit 11, a discharge unit 12, a humidification unit 20, and a control unit 13. A sheet is conveyed by a conveying mechanism which includes a roller pair and belt along a sheet conveying path indicated by solid lines in FIG. 1, and is processed by the respective units.

The sheet supply unit 1 is a unit for holding and supplying the continuous sheet wound up in the roll shape. The sheet supply unit 1 can accommodate two rolls R1 and R2, and alternatively pull out and supply the sheet. A number of rolls that can be accommodated is not limited to two, and a sheet supply unit that can accommodate one, or three or more rolls may be used.

The decurling unit 2 is a unit that reduces a curl (warpage) of the sheet supplied from the sheet supply unit 1. In the decurling unit 2, a decurling force is caused to act on the sheet by using two pinch rollers for one drive roller, and causing curvature in the sheet and causing the sheet to pass therethrough so as to exert warpage opposite to the curl, thus reducing the curl.

The skew correction unit 3 is a unit that corrects a skew (inclination in relation to an inherent traveling direction) of the sheet which has passed through the decurling unit 2. The skew of the sheet is corrected by pressing sheet edge at a reference side against a guide member.

The printing unit 4 is a unit that performs print processing on the sheet by the print head 14 from above onto the conveyed sheet to form an image thereon. In other words, the printing unit 4 is a processing unit that performs predetermined processing on the sheet. The printing unit 4 is provided with a plurality of conveying rollers for conveying the sheet.

The print head 14 has a line type print head in which nozzle array of an inkjet scheme is formed within a range to cover a maximum width of the sheet in any conceivable use. The print head 14 has a plurality of print heads aligned parallel along a conveying direction of the sheet. In the present exemplary embodiment, the print head 14 has four print heads corresponding to four colors of C (Cyan), M (Magenta), Y (Yellow), and K (Black). A number of colors and a number of the print heads are not limited to four.

The inkjet scheme can employ a scheme using heating element, a scheme using piezoelectric element, a scheme using electrostatic element, a scheme using micro-electro-mechanical system (MEMS) element, and others. The inks of respective colors are supplied from the ink tanks to the print head 14 via ink tubes.

The inspection unit 5 is a unit for determining whether images have been correctly printed by optically reading out inspection patterns or images printed on the sheet by the printing unit 4, and inspecting a status of nozzles of the print heads, sheet conveyance status, image position and the like. The scanner has a charge-coupled device (CCD) image sensor or a complementary metal-oxide-semiconductor (CMOS) image sensor.

The cutter unit 6 is a unit provided with a mechanical cutter for cutting the sheet which has been printed to a predetermined length. The cutter unit 6 is provided with a plurality of conveying rollers for feeding out the sheet to next step.

The information recording unit 7 is a unit that records print information (specific information) such as serial number and date of print in non-printed region of the cut sheet. The recording is performed by printing characters and codes by an inkjet scheme, or a thermal transfer scheme. At an upstream side of the information recording unit 7 and at downstream side of the cutter unit 6, there is provided a sensor 23 which detects edge of the cut sheet. In other words, the sensor 23 detects the edge of the sheet between the cutter unit 6 and a recording position by the information recording unit 7. Based on detection timing of the sensor 23, timing at which information recording is performed by the information recording unit 7 is controlled.

The drying unit 8 is a unit for heating the sheet printed by the printing unit 4, which dries applied ink in a short time. Inside the drying unit 8, hot air is applied to the passing sheet from at least under surface side to dry an ink-applied surface. The drying scheme is not limited to a scheme for applying hot air. A scheme for irradiating sheet front surface with electromagnetic wave (e.g., ultraviolet rays or infrared rays) may be used.

The sheet conveying path from the above-described sheet supply unit 1 to the drying unit 8 is referred to as a first path. The first path has a U-turn shape between the printing unit 4 and the drying unit 8. The cutter unit 6 is located halfway through the U-turn shape.

The reversing unit 9 is a unit for temporarily winding up the continuous sheet on which front surface printing is finished when two-sided print is performed, and reversing the front and back surfaces of the sheet. The reversing unit 9 is provided halfway through a path (referred to as a loop path, or a second path) extending from the drying unit 8 by way of the decurling unit 2 up to the printing unit 4 to supply again the sheet, which has passed through the drying unit 8, to the printing unit 4.

The reversing unit 9 is provided with a winding rotary member (drum) which rotates to wind up the sheet. The continuous sheet on which printing of the front surface has been finished but not yet cut is temporarily wound up over the winding rotary member. When the winding up is finished, the winding rotary member rotates reversely and the wound-up sheet is supplied to the decurling unit 2, and carried to the printing unit 4. Since the front surface of the sheet is reversed, the printing unit 4 can perform printing on the back surface. Specific operation of two-sided print will be described below.

The discharge and conveyance unit 10 is a unit for conveying the sheet cut by the cutter unit 6 and dried by the drying unit 8, and passing the sheet to the sorter unit 11. The discharge and conveyance unit 10 is provided on a path (referred to as a third path) different from the second path provided in the reversing unit 9. Here is provided a path switching mechanism having a movable flapper at a branch position of the paths, for selectively guiding the sheet conveyed on the first path to either one of the second path and the third path.

The sorter unit 11 and the discharge unit 12 are provided at the side of the sheet supply unit 1 and at the end of the third path. The sorter unit 11 is a unit for sorting the printed sheets for each group as the needs arises. The sorted sheets are discharged to the discharge unit 12 which includes a plurality of trays. In such a layout, the third path passes through a lower part of the sheet supply unit 1, and discharges the sheet to the side opposite to the printing unit 4 or the drying unit 8 across the sheet supply unit 1.

The humidification unit 20 is a unit for producing humidified gas (air), and supplying the humidified gas to a space between the print head 14 of the printing unit 4 and the sheet. As a result, ink drying in nozzles of the print head 14 is suppressed. For a humidification of the humidification unit 20, a scheme such as a vaporization type, a water spray type, or a steam type is employed. The vaporization type includes a permeable membrane type, a submembrane osmosis type, a capillary tube type and so forth, in addition to a rotation type according to the present exemplary embodiment. The water spray type includes an ultrasonic type, a centrifugal type, a high-pressure spray type, a two-fluid spray type and so forth. The steam type includes a steam piping type, an electrothermal type, an electrode type, and so forth.

The humidification unit 20 and the printing unit 4 are connected by a first duct 21, and further the humidification unit 20 and the drying unit 8 are connected by a second duct 22. In the drying unit 8, when the sheet is dried, humid and hot gas is produced. The gas is introduced into the humidification unit 20 through the second duct 22, and is utilized as auxiliary energy of humidified gas production in the humidification unit 20. Then, the humidified gas produced in the humidification unit 20 is introduced into the printing unit 4 through the first duct 21.

The control unit 13 is a unit that performs control of respective units of the entire printing apparatus. The control unit 13 includes a central processing unit (CPU), a storage apparatus, a controller (control unit) provided with various types of control units, an external interface, and an operation unit 15 from/to which a user performs input and output. Operation of the printing apparatus is controlled according to an instruction from the controller, or a host apparatus 16 such as a host computer connected to the controller via the external interface.

Figure 2:
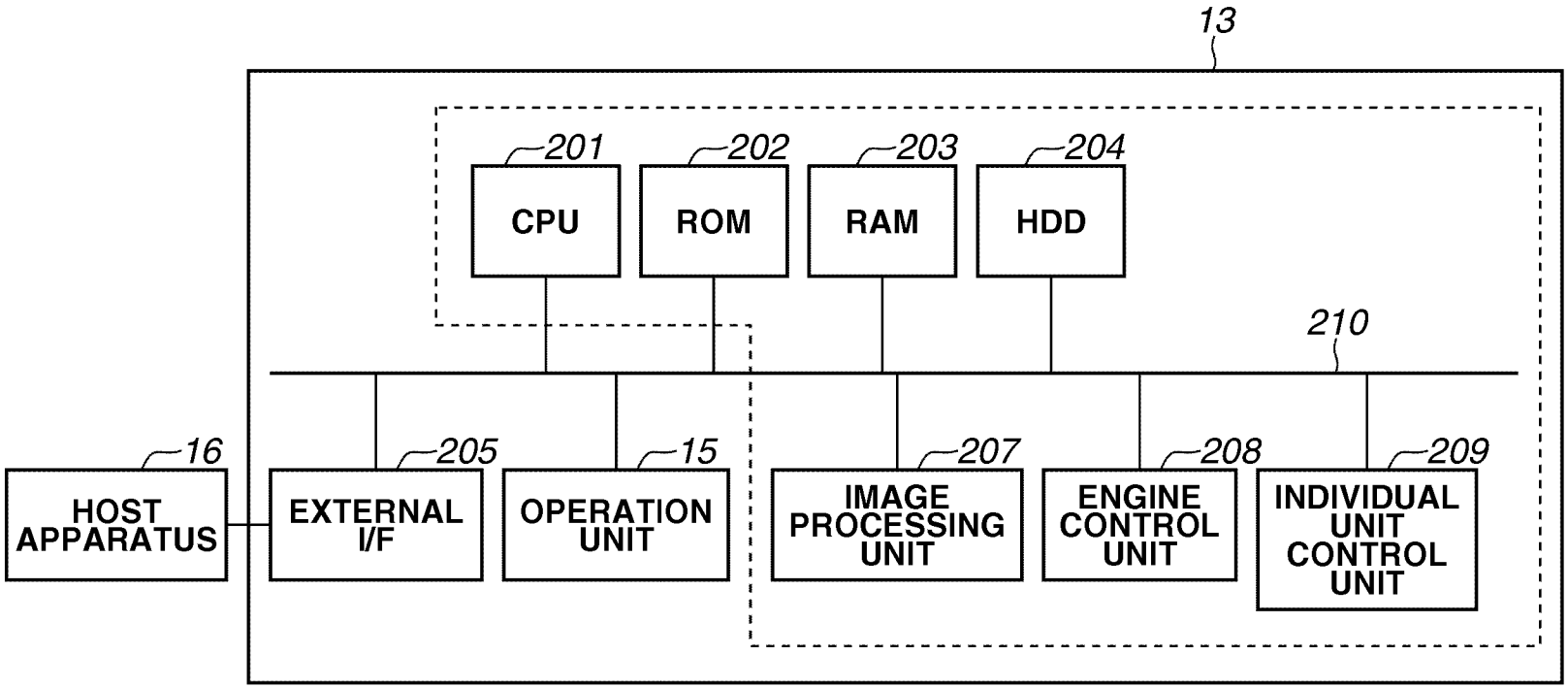
FIG. 2 is a block diagram of a control unit.

FIG. 2 is a block diagram illustrating a concept of the control unit 13. The controller (range surrounded by dashed line) provided in the control unit 13 includes a central processing unit (CPU) 201, a read-only memory (ROM) 202, a random-access memory (RAM) 203, a hard disk drive (HDD) 204, and image processing unit 207, an engine control unit 208, and an individual units control unit 209.

The CPU 201 controls operation of respective units of the printing apparatus in an integrated manner. The ROM 202 stores a program for causing the CPU 201 to execute, and fixed data necessary for various types of operations of the printing apparatus. The RAM 203 is used as a work area of the CPU 201, or is used as temporary storage region of various received data, and stores various types of setting data. The HDD 204 can store and read a program for causing the CPU 201 to execute, print data, and setting information necessary for various types of operations of the printing apparatus.

The operation unit 15 is an input and output interface with the user, and includes an input unit such as hardware key or touch panel, and an output unit such as display for presenting information or voice generation machine. For example, a display with touch panel is used, and operating status of the apparatus, print status, maintenance information (e.g., remaining amount of ink, remaining amount of sheets, maintenance status) are displayed thereon for the user. The user can input various types of information from the touch panel.

For a unit that requires high-speed data processing, dedicated processing unit is provided. The image processing unit 207 performs image processing of print data handled in the printing apparatus. Color spaces (e.g., YCbCr) of input image data are converted into standard RGB color spaces (e.g., sRGB). In addition, various image processing such as resolution conversion, image analysis, image correction are executed on image data as the needs arises. The print data obtained by these image processing is stored in the RAM 203 or the HDD 204.

The engine control unit 208 performs also drive control of the print head 14 of the printing unit 4 according to print data, based on control command received from the CPU 201 or the like. The individual unit control unit 209 is a subcontroller for individually controlling each of the sheet supply unit 1, the decurling unit 2, the skew correction unit 3, the inspection unit 5, the cutter unit 6, the information recording unit 7, the drying unit 8, the reversing unit 9, the discharge and conveyance unit 10, the sorter unit 11, the discharge unit 12, and the humidification unit 20. Based on the command issued by the CPU 201, operation of each unit is controlled by the individual unit control unit 209.

An external interface 205 is an interface (I/F) for connecting the controller to the host apparatus 16, and serves as a local I/F or a network I/F. The components are connected to one another by the system bus 210.

The host apparatus 16 is an apparatus which serves as a supply source of image data for causing the printing apparatus to perform printing operation. The host apparatus 16 may be a general-purpose or dedicated computer, or may be a dedicated image equipment such as an image capture, a digital camera, a photo storage having an image reader. If the host apparatus 16 is a computer, an operating system (OS), application software for generating image data, and a print driver for printing apparatus is installed in a storage apparatus included in the computer.

It is not essential to realize all of the above-described processing by software, but apart or the whole may be realized by hardware.

Next, basic operation at the time of printing will be described. Since operation of printing is different between single-sided print mode and two-sided print mode, each mode will be described.

Figure 3:
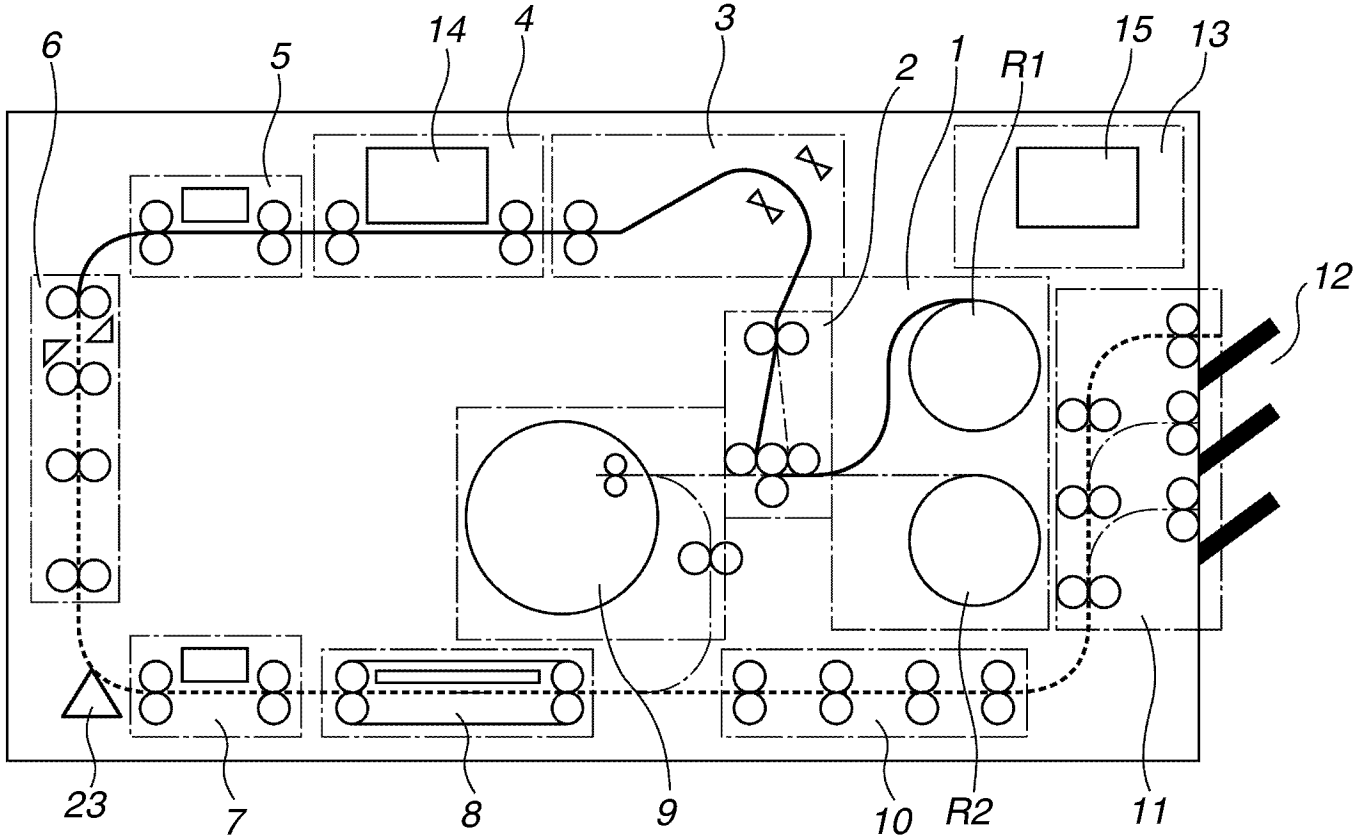
FIG. 3 is an explanatory view for explaining an operation of single-sided print mode.

FIG. 3 is an explanatory view for explaining an operation in the single-sided print mode. The conveying path after the sheet supplied from the sheet supply unit 1 has been printed, and until it is discharged to the discharge unit 12 is indicated by a bold line. The sheet supplied from the sheet supply unit 1, and each processed by the decurling unit 2 and the skew correction unit 3 is subjected to printing of front surface (first surface) in the printing unit 4. On the long-length continuous sheet, images (unit images) of a predetermined length in the conveying direction are printed in sequence, and a plurality of images is formed side-by-side.

Passing through the inspection unit 5, the printed sheet is cut into cut-sheets for each unit image in the cutter unit 6. Print information is recorded by the information recording unit 7 on back surfaces of the cut-sheets as the need arises. Then, the cut sheets are conveyed one by one to the drying unit 8, where drying operation is performed. After that, passing through the discharge and conveyance unit 10, the cut sheets are discharged in sequence to the discharge unit 12 of the sorter unit 11 and loaded in stack there.

On the other side, after the last unit image is cut, the sheets left at the printing unit 4 side are sent back to the sheet supply unit 1, and wound up over the roll R1 or R2. In such a way, in the single-sided print, the sheets are processed while passing through the first path and the third path, without passing through the second path.

Figure 4:
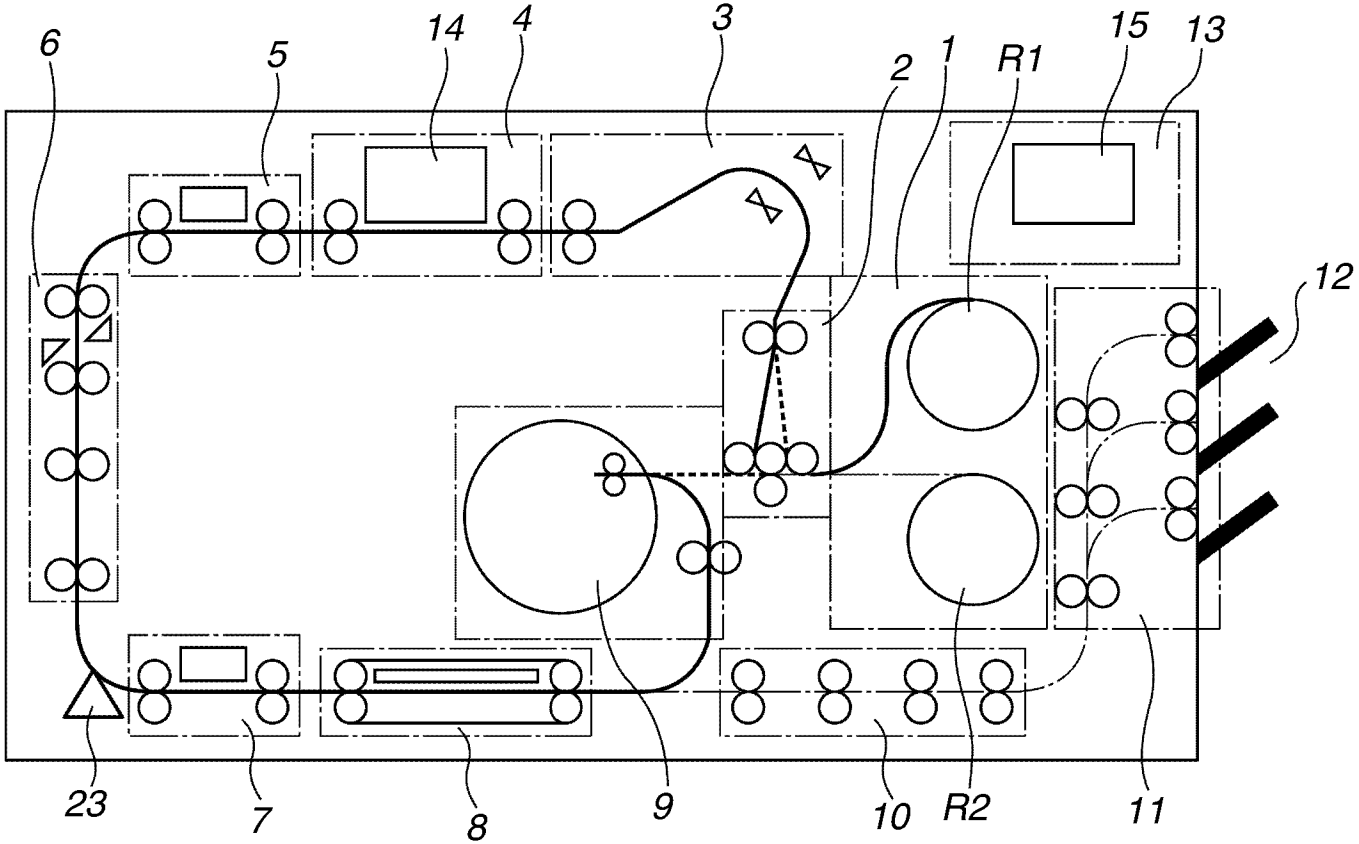
FIG. 4 is an explanatory view for explaining an operation of two-sided print mode.

FIG. 4 is an explanatory view for explaining an operation in the two-sided print mode. In the two-sided print, back surface (second surface) print sequence is executed subsequent to front surface (first surface) print sequence. In the first front surface print sequence, operation in each unit located between the sheet supply unit 1 and the inspection unit 5 is the same as the above-described operation of the single-sided print. In the cutter unit 6, continuous sheet is conveyed to the drying unit 8 as it is, without performing cutting operation for each unit image.

After ink of front surface has been dried in the drying unit 8, the sheet is guided to the path (second path) at the reversing unit 9 side, instead of the third path) at the discharge and conveyance unit 10 side. In the second path, the reversing unit 9 that rotates in forward direction (counterclockwise direction in FIG. 4) completely winds up the sheet up to the sheet trailing edge (cut position).

On the other side, concurrently with the winding-up, continuous sheet left at the conveying direction upstream side (at the printing unit 4 side) of the cut position is wound back to the sheet supply unit 1 and wound up over the roll R1 or R2, so that the sheet end (cut position) may not be left in the decurling unit 2. Through this winding back of the sheet, collision with the sheet which is again supplied in back surface print sequence described below is avoided.

After the above-described front surface print sequence, the sequence is switched to the back surface print sequence. The winding rotary member of the reversing unit 9 rotates in a direction opposite to the one at the time of winding up (clockwise direction in FIG. 4. End of the wound up sheet (sheet trailing edge at the time of winding up becomes sheet leading edge at the time of feeding out) is fed into the decurling unit 2 along the path indicated by the dashed line in FIG. 4. In the decurling unit 2, the curl created by the winding rotary member is corrected. That is, the decurling unit 2 is provided between the sheet supply unit 1 and the printing unit 4 in the first path, and between the reversing unit 9 and the printing unit 4 in the second path, and becomes a common unit that acts as the decurling unit in either path.

The sheet with reversed front and back surfaces, after passing through the skew correction unit 3, is carried to the printing unit 4, and printing is performed on back surface of the sheet. Passing through the inspection unit 5, the printed sheet is cut to a predetermined unit length preset in the cutter unit 6. Since the cut-sheets are printed on two-sides, recording in the information recording unit 7 is not performed. The cut-sheets are conveyed one by one to the drying unit 8, and after passing through the discharge and conveyance unit 10, the cut-sheets are discharged and stacked in sequence to the discharge unit 12 of the sorter unit 11. In such a way, in the two-sided print, the sheets are processed passing through the first path, the second path, the first path, the third path in this order.

Figure 5:
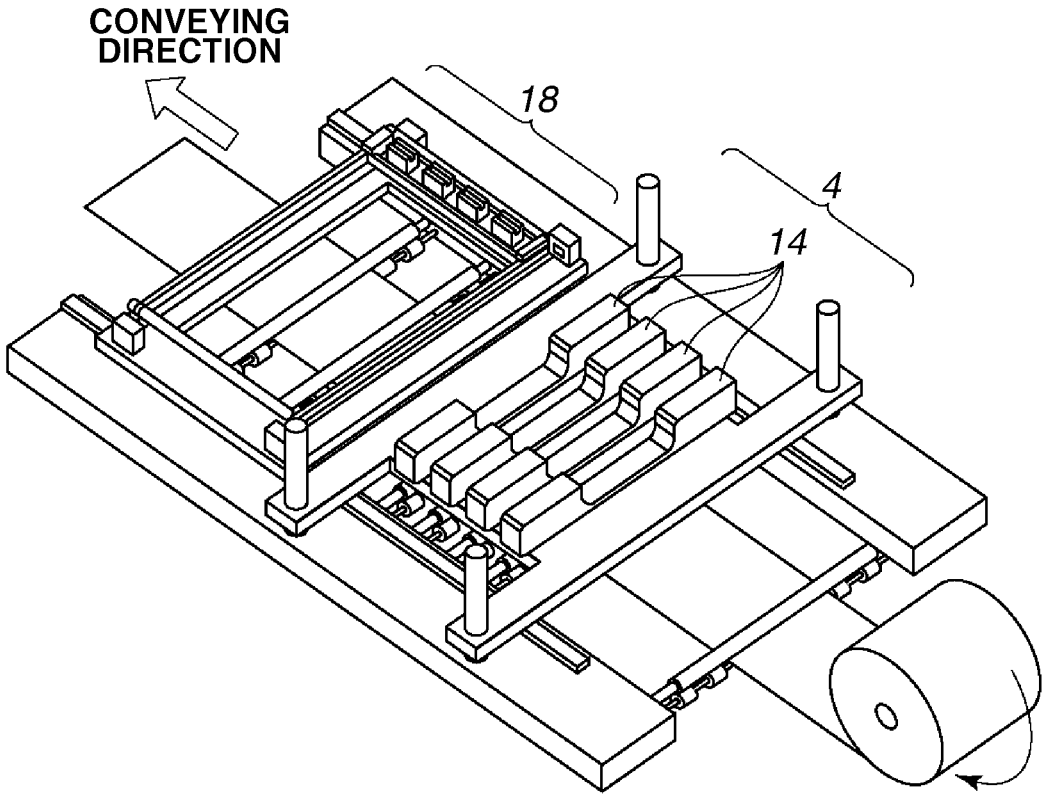
FIG. 5 is a perspective view illustrating a print state of the printing apparatus.

FIG. 5 is a perspective view illustrating print status of the printing apparatus. As described above, the print head 4 has a plurality of print heads 14 aligned parallel along a conveying direction. FIG. 5 illustrates the print heads 14 corresponding to four colors of C (Cyan), M (Magenta), Y (Yellow), and K (Black).

A cleaning unit 18 performs cleaning operation for the print head 14. In printing status in which printing of the sheet is being performed by the print head 14, the cleaning unit 18 is moved to downstream side of the printing unit 4 in the conveying direction. The cleaning unit 18 is provided with a wiper slidably contacting an ejecting port surface of the print head 14, and a cap which performs capping of the ejecting port surface of the print head 14 and sucks ink from the print head.

Figure 6:
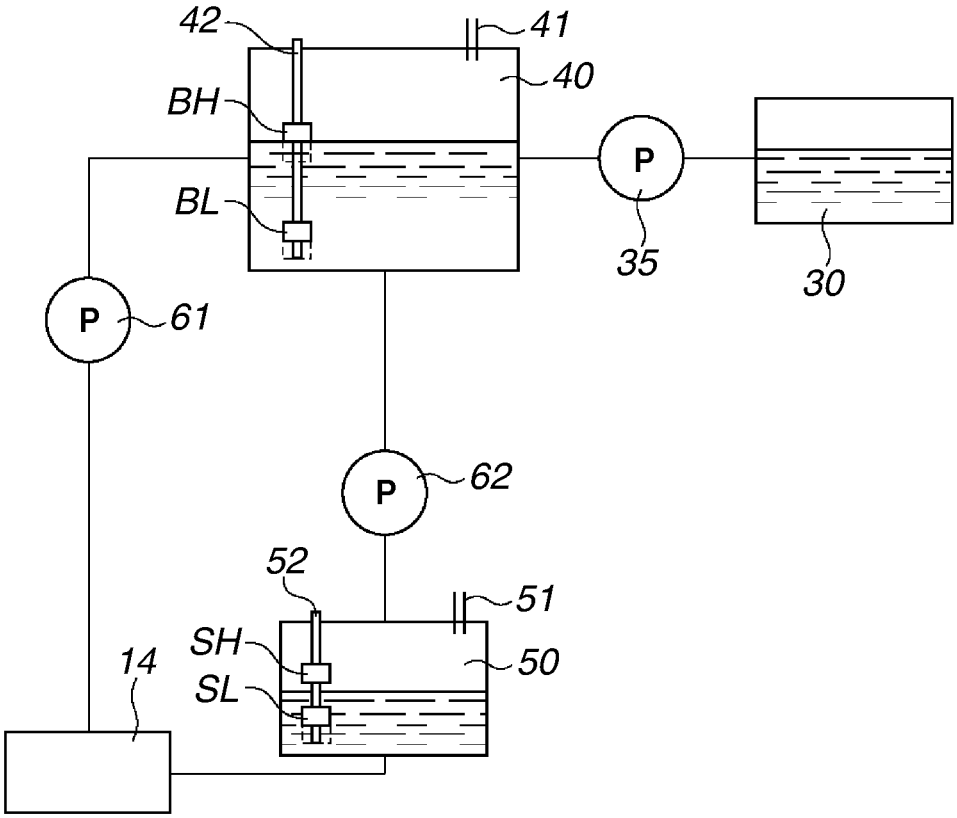
FIG. 6 is an explanatory view for explaining an ink circulation and supply mechanism.

FIG. 6 is an explanatory view for explaining the ink circulation and supply mechanism. As described above, in the present exemplary embodiment, the print head 14 has four print heads for C (Cyan), M (Magenta), Y (Yellow), and K (Black). Since the ink circulation and supply mechanism has similar configuration for each color, the ink circulation and supply mechanism for one color will be described with reference to FIG. 6.

In FIG. 6, an ink tank 30 retains ink to be supplied to the print head. The ink tank 30 is freely attachable to and detachable from the printing apparatus main body. A buffer tank 40 is a first reservoir tank, to which the ink is first supplied from the ink tank 30. A subtank 50 is a second reservoir tank, to which the ink is supplied from the buffer tank 40. The ink is supplied from the subtank 50 to the print head 14.

The buffer tank 40 is provided at the highest position in the ink circulation and supply path. The print head 14 has different positions in a vertical direction, between when printing is performed on the sheet, and when cleaning operation is performed. The subtank 50 is provided at a position to which the ink never drips off from a nozzle of the print head 14, or where air never flows into the nozzle, even when the print head 14 is situated at either position.

A supply pump 35 is used to supply the ink from the ink tank 30 to the buffer tank 40. A first circulating pump 61 is provided in a circulation and supply path between the print head 14 and the buffer tank 40. By driving the first circulating pump 61, ink reserved in the subtank 50 is supplied to the print head 14, and ink which has not been used for printing in the print head 14 is reclaimed by the buffer tank 40.

A second circulating pump 62 is provided in a circulation and supply path between the buffer tank 40 and the subtank 50. By driving the second circulating pump 62, ink reserved in the buffer tank 40 is supplied to the subtank 50.

The first circulating pump 61, the second circulating pump 62, and the supply pump 35 are tube pumps capable of generating pressure by rotating and driving a tube while stroking with a roller. A stepping motor is used for driving these pumps.

An atmosphere communicating port 41 is provided on the top of the buffer tank 40. By the atmosphere communicating port 41, air bubbles accumulated within the buffer tank 40 are discharged to the outside of the tank. A buffer tank sensor 42 serves as a second liquid level detecting means. The buffer tank sensor 42 is provided with a shaft fixed to the buffer tank 40, a buffer tank upper float BH and a buffer tank lower float BL such that the shaft penetrates therethrough and is vertically movable within a predetermined range.

The buffer tank upper float BH and the buffer tank lower float BL have greater specific gravity than that of air, and smaller specific gravity than that of an ink. For this reason, when liquid level of the ink becomes higher than the float, the float moves upward. However, upward movement of the float is regulated by a regulating unit to a predetermined position. Further, when a liquid level of the ink becomes lower than the float, the float moves downward. However, downward movement of the float is regulated by the regulating unit to a predetermined position.

A magnetic switch is provided inside the shaft. When the float moves in a height direction in response to a height of the liquid level, positions of the buffer tank upper float BH and the buffer tank lower float BL are detected by the magnetic switch, thereby a position of the liquid level of the ink can be detected.

An atmosphere communicating port 51 is provided on the top of the subtank 50. Through the atmosphere communicating port 51, air bubbles accumulated within the subtank 50 are discharged to the outside of the tank. A subtank sensor 52 serves as a first liquid surface detection means. The subtank sensor 52 is provided with a shaft, a subtank upper float SH, and a subtank lower float SL, similar to the buffer tank sensor 4.

FIG. 7 is an explanatory view for explaining a configuration for attaching and detaching the print head to and from the ink circulation and supply mechanism. As described above, in the present exemplary embodiment, the print head 14 has four print heads corresponding to four colors of C (Cyan), M (Magenta), Y (Yellow), and K (Black). The four print heads can be attached to and detached from the ink circulation and supply mechanism. Further, the four print heads have the same configuration. For this reason, the print heads can be mounted on the ink circulation and supply mechanism of any color.

FIG. 7 illustrates the ink circulation and supply mechanism for one color with simplified configuration. In FIG. 7, a print head 14, a subtank 50, and a second circulating pump 62 are illustrated.

Figure 7A:
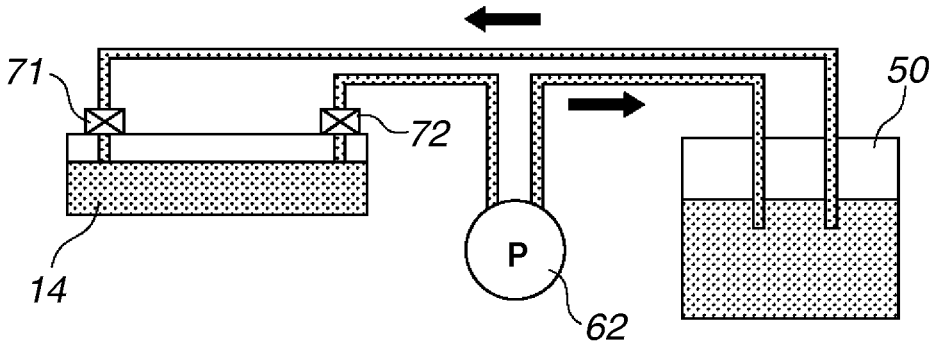
FIGS. 7A, 7B, and 7C are explanatory views for explaining a configuration for attaching and detaching a print head to and from the ink circulation and supply mechanism.

FIG. 7A illustrates a state in which the print head 14 is mounted on the head mounting unit of the ink circulation and supply mechanism, and the ink is circulated through the ink circulation and supply mechanism, and print operation is performed by ejecting the ink from the print head 14.

Figure 7B:
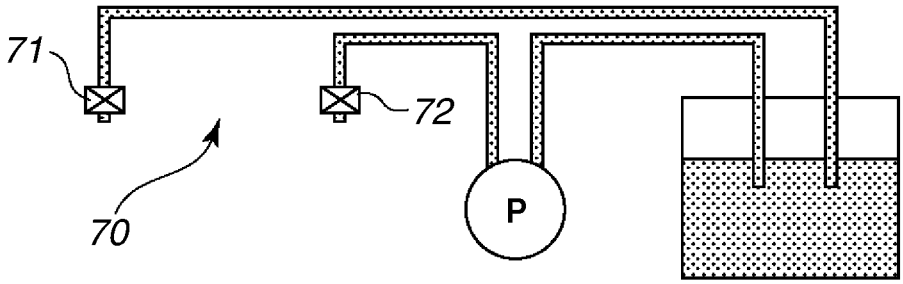

FIG. 7B is an explanatory view for explaining a state in which the print head 14 is removed from a head mounting unit 70. In the ink circulation and supply mechanism, a first valve mechanism 71 is provided upstream of the head mounting unit 70, and a second valve mechanism 72 is provided downstream.

When the print head 14 is removed from the head mounting unit 70, drives of the second circulating pump 62 and the first circulating pump (not illustrated) are stopped. After that, the first valve mechanism 71 and the second valve mechanism 72 are closed. By closing the valve mechanisms 71 and 72, the print head 14 is released from communication of the ink with the ink circulation and supply mechanism, and the ink can be prevented from being supplied to the print head 14. Consequently, the print head 14 can be removed from the head mounting unit 70.

Figure 7C:
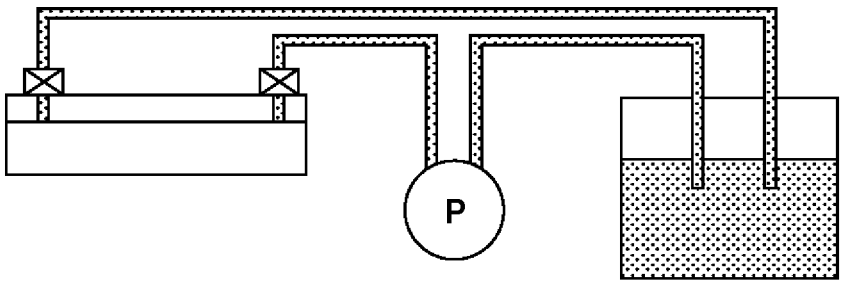

FIG. 7C is an explanatory view for explaining a state in which the print head 14 is mounted on the head mounting unit 70. After the print head 14 is mounted on the head mounting unit 70, the first valve mechanism 71 and the second valve mechanism 72 are opened. By opening the valve mechanisms 71 and 72, the print head 14 communicates with the ink circulation and supply mechanism, and the ink can be supplied to the print head 14. After that, by driving the second circulating pump 62 and the first circulating pump (not illustrated), the ink is supplied from the subtank 50 to the print head 14.

Figure 8:
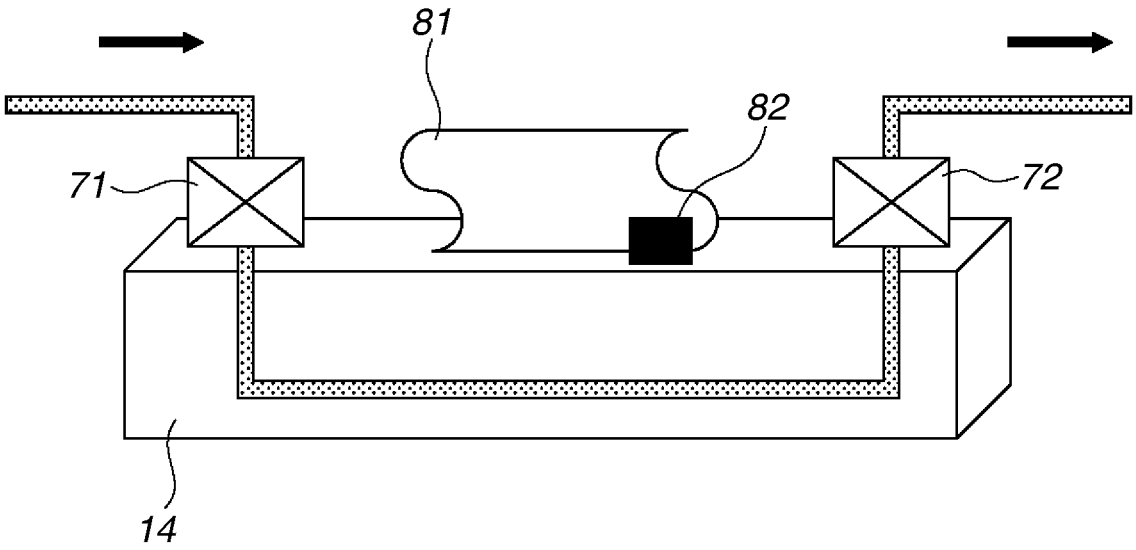
FIG. 8 is a perspective view illustrating the print head.

FIG. 8 is a perspective view for explaining the print head. In FIG. 8, a connecting cable 81 is illustrated. After the print head 14 is mounted on the head mounting unit 70, electrical connection between the print head 14 and the apparatus main body is established by connecting the connecting cable 81 with the apparatus main body.

In FIG. 8, a storage region 82 is also illustrated. In a recording area 82, information whether the print head has been previously mounted on the head mounting unit (the ink circulation and supply mechanism) is stored. When the print head is mounted on the head mounting unit, a flag representing that it has been used is stored in the storage region of the mounted print head, and color information of the ink circulation and supply mechanism, on which the head has been mounted, is stored therein. As used herein, "previously has been mounted on the head mounting unit" is not limited to having been mounted on the subject printing apparatus main body, but also includes having been mounted on other printing apparatus main bodies.

On the other hand, since a print head, which has never been previously mounted on the head mounting unit (the ink circulation and supply mechanism) has no flag, it is recognized as a new print head. As used herein, when the print head "has never been previously mounted on the head mounting unit", it means that it has not been mounted on the subject printing apparatus main body, or on any other printing apparatus main bodies.

In the present exemplary embodiment, the print head 14 has the heads corresponding to four colors of C (Cyan), M (Magenta), Y (Yellow), and K (Black). However, the print heads for LC (light cyan), LM (Light magenta), G (Gray) and other colors may be provided. At this time, C (Cyan) and LC (Light cyan) have different color information as separate colors. Further, M (Magenta) and LM (Light magenta) have different color information as separate colors. Furthermore, in order to enhance image quality, the print head for ejecting processing liquid may be provided. In this case, the processing liquid also has color information.

Features of the invention of the present application, when the print heads are attachable to and detachable from a plurality of head mounting units, are predicated on a configuration in which common print heads are mountable thereon. Then, if a mounted print head and a head mounting unit on which the print head has been mounted do not correspond to each other, an ink (processing liquid) may be supplied to the mounted print head, thus causing a problem such as color mixture. According to the present invention, such a problem is prevented.

Figure 9:
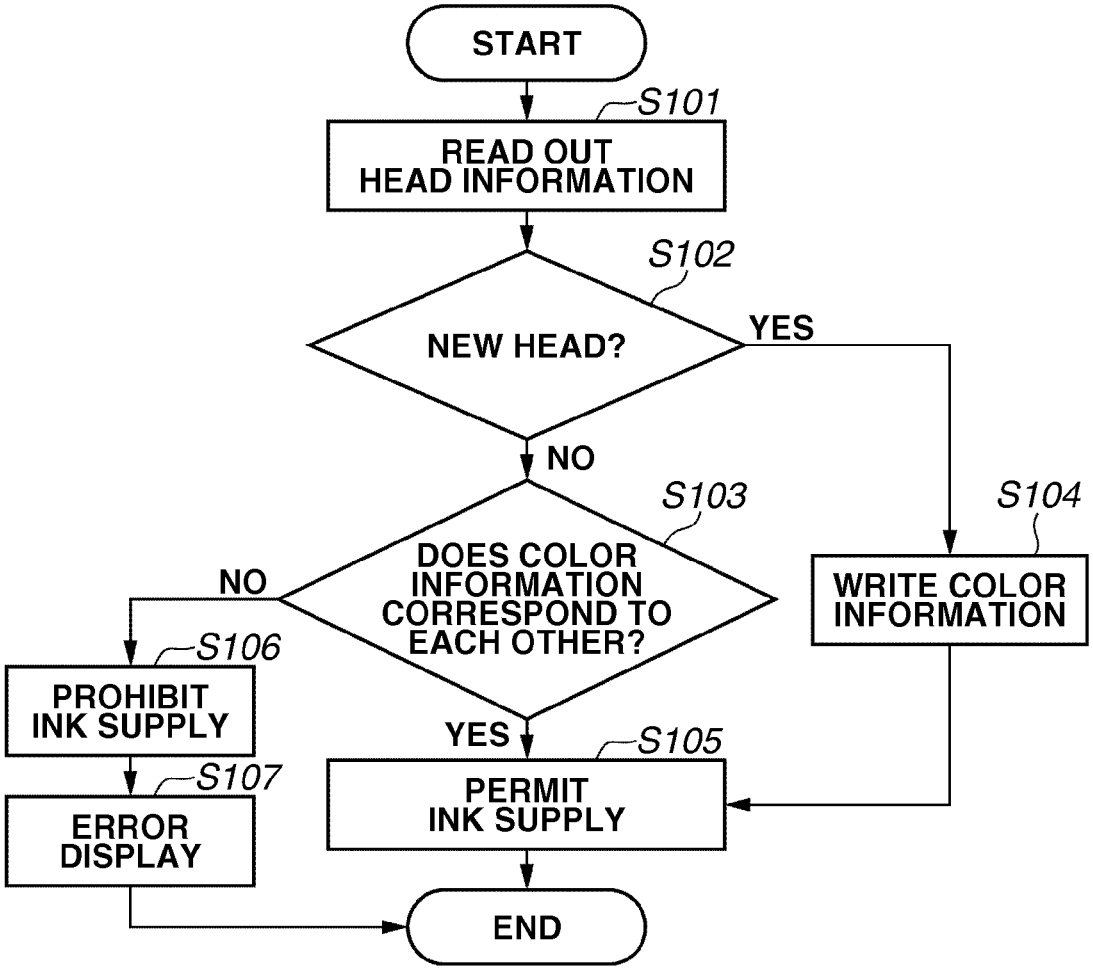
FIG. 9 is a flowchart for illustrating operation when the print head is mounted on a head mounting portion.

FIG. 9 is a flowchart explaining an operation when the print head is mounted on the head mounting unit. First in step S101, when the print head having been mounted on an apparatus main body (ink circulation and supply mechanism) is detected by a sensor or the like, the control unit of the apparatus main body reads out information from a storage region of the mounted print head. If the mounted print head has been previously mounted on the ink circulation and supply mechanism, color information of the ink circulation and supply mechanism, on which the print head has been mounted, is stored in the storage region. If the mounted print head is new, color information is not stored.

In step S102, it is determined whether the mounted print head is new. If the mounted print head is not new (NO in step S102), more specifically, it has been previously mounted on the head mounting unit (ink circulation and supply mechanism), then the processing proceeds to step S103. As used herein, "previously has been mounted on the head mounting unit" is not limited to having been mounted on the subject printing apparatus main body, but also includes having been mounted on other printing apparatus main bodies.

On the other hand, if the mounted print head is new (YES in step S102), more specifically, if it has been mounted for the first time on the head mounting unit (ink circulation and supply mechanism), then the processing proceeds to step S104. As used herein, the print head "has been mounted for the first time" not only means that it has been mounted for the first time on this printing apparatus main body, but also means that it been mounted for the first time on the printing apparatus including other printing apparatus main bodies.

If it is determined that the mounted print head is new in step S102, then in step S104, color information of the head mounting unit (ink circulation and supply mechanism), on which the print head has been mounted, is stored in the storage region of the print head. Then, in step S105, ink supply to the mounted print head is permitted. More specifically, the ink is supplied to the mounted print head to perform the ink circulation operation, by opening the first valve mechanism 71 and the second valve mechanism 72, and driving the pump. If the mounted print head is new, there is no possibility of color mixture. Therefore, even when the print head is mounted on a head mounting unit (ink circulation and supply mechanism) for any color, the ink supply will cause no problem.

On the other hand, if it is determined that the mounted print head is not new in step S102 (NO in step S102), then in step S103, it is determined whether color information of the mounted print head and color information of the head mounting unit correspond to each other.

If it is determined that color information of the print head and color information of the head mounting unit correspond to each other in step S103 (YES in step S103), then the processing proceeds to step S105. Then, in step S105, the ink supply to the mounted print head is permitted. More specifically, the ink is supplied to the mounted print head to perform the ink circulation operation, by opening the first valve mechanism 71 and the second valve mechanism 72, and driving the pump.

For example, to a first head mounting unit 70, a C (Cyan) ink as an ink of the first color is supplied from the first ink tank 30 containing the ink of the first color. It corresponds to the case where, a first print head 14, in which color information of the C (CYAN) is stored in the storage region 82, is mounted on the first head mounting unit 70. Also, to a second head mounting unit 70, a M (Magenta) ink as an ink of a second color is supplied from a second ink tank 30 containing the ink of the second color. It corresponds to the case where, a second print head 14, in which color information of the M (Magenta) is stored in the storage region 82, is mounted on the second head mounting unit 70.

At this time, color information of the print head and color information of the head mounting unit, on which the print head is mounted, correspond to each other. If color information of the print head and color information of the head mounting unit correspond to each other, there is no possibility of color mixture, and thus even if the ink is supplied, there is no problem.

On the other hand, if it is determined that color information of the print head and color information of the head mounting unit do not correspond to each other in step S103 (NO in step S103), then in step S106, the ink supply is prohibited, and then error is displayed in step S107.

For example, to the first head mounting unit 70, the C (Cyan) ink as the ink of the first color is supplied from the first ink tank 30 containing the ink of the first color. It corresponds to the case where, on the first head mounting unit 70, the second print head 14, in which color information of M (Magenta) is stored in the storage region 82, is mounted. Also, to the second head mounting unit 70, the M (Magenta) ink as the ink of the second color is supplied from the second ink tank 30 containing the ink of the second color. It corresponds to the case where, on the second head mounting unit 70, the first the print head 14, in which color information of the C (Cyan) is stored in the storage region 82, is mounted.

If color information of the print head and color information of the head mounting unit do not correspond to each other, there is possibility of color mixture. Therefore, the ink supply is prohibited, without opening the first valve mechanism 71 and the second valve mechanism 72. Also, in step S107, error is displayed, thereby a user can know that the mounted print head has been mounted on an inappropriate head mounting unit. The print head, which has been mounted on the inappropriate head mounting unit, can be used by mounting it once again on the head mounting unit which corresponds to color information of the print head.

To prevent drying in the vicinity of ejecting portion at the time of shipment of the print head, it may be shipped filled with hard-to-dry ink. In such a case, after it is determined as a new head in step S102, then in step S105, a sequence for ejecting an ink filled into the print head, before the ink circulation operation is started, may be added. By ejecting the ink filled into the print head, color mixture can be more effectively prevented within the circulation and supply path.

As a configuration for ejecting the ink, pressure may be exerted inside the print head, or negative pressure may be produced outside the print head and sucking the ink from the ejecting portion.

Further, if inappropriate print head is mounted in step S106, even though the valve mechanism is not opened, there is fear that some color mixture may occur. In this case, error is displayed, and an ink discharge sequence such as discharging the ink by utilizing a pressure of the pump may be performed.

Alternatively, previous usage history of the print head may be stored in the storage region of the print head. The usage history includes, for example, a number of ejections of the print head, and drive voltage. When the print head is mounted on the ink circulation and supply mechanism, the usage history may be read out, and drive condition of the print head may be determined from a number of ejections or the like. If a new print head is mounted, drive condition may be determined by recording test patterns, or the like.

According to the above-described exemplary embodiment, in a configuration in which a plurality of ink supply mechanisms is provided, there is no need to prepare a print head for each ink supply mechanism, and common print heads can be mounted. Further, common print heads can be used and yet color mixture of the inks can be prevented.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-217189 filed Sep. 28, 2010, which is hereby incorporated by reference herein in its entirety.

What is claimed is:

1. A printing apparatus comprising:

a first ink tank configured to contain ink of a first color;

a second ink tank configured to contain ink of a second color;

a first head mounting unit configured to mount a print head, wherein a print head mounted on the first head mounting unit is configured to receive first color ink from the first ink tank and eject the first color ink; and a second head mounting unit configured to mount a print head, wherein a print head mounted on the second head mounting unit is configured to receive second color ink from the second ink tank and eject the second color ink, wherein the first head mounting unit and the second head mounting unit each are configured to mount a same print head that includes a storage region configured to receive and store information from a plurality of mountings, wherein, in response to the print head being mounted on the first head mounting unit, the storage region is configured to receive and store color information of the first head mounting unit and, in response to the print head being mounted on the second head mounting unit, the storage region is configured to receive and store color information of the second head mounting unit.

2. The printing apparatus according to claim 1, wherein, in response to the print head being mounted on the first head mounting unit and it being determined that color information is not stored in the storage region of the print head, first color ink is supplied from the first ink tank to the print head.

3. The printing apparatus according to claim 2, wherein, in response to the print head being mounted on the first head mounting unit, color information of the first head mounting unit is stored in the storage region of the print head.

4. The printing apparatus according to claim 1, wherein, in response to the print head being mounted on the first head mounting unit and it being determined that color information is stored in the storage region of the print head, it is determined whether the color information stored in the storage region and the color information of the first head mounting unit correspond to each other.

5. The printing apparatus according to claim 4, wherein, in response to determining that the color information stored in the storage region and the color information of the first head mounting unit correspond to each other, first color ink is supplied from the first ink tank to the print head.

6. The printing apparatus according to claim 4, wherein, in response to determining that the color information stored in the storage region and the color information of the first head mounting unit do not correspond to each other, first color ink is prohibited from being supplied from the first ink tank to the print head.

7. The printing apparatus according to claim 1, wherein the print head is shipped in a state where ink is included in the print head at time of shipment.

8. The printing apparatus according to claim 1, wherein usage history of the print head is stored in the storage region of the print head.

* * * * *